US005913496A

United States Patent [19]

Valdez

[11] Patent Number: 5,913,496

[45] Date of Patent: Jun. 22, 1999

[54] SNAP-RING STIFFENER APPARATUS HAVING A SCOOP-LIKE EDGE AND METHOD FOR STIFFENING BAG OPENINGS AND OTHER FLEXIBLE FABRICS

[76] Inventor: Victor G. Valdez, 2512 Palo Dulce Dr., Tucson, Ariz. 85745

[21] Appl. No.: 08/678,231

[22] Filed: Jul. 11, 1996

[51] Int. Cl.[6] ..... B65B 67/04

[52] U.S. Cl. ..... 248/99; 248/95; 248/97; 24/461

[58] Field of Search ..... 248/99, 97, 95; 24/461

[56] References Cited

U.S. PATENT DOCUMENTS

| | | | |
|---|---|---|---|
| 3,893,649 | 7/1975 | Cornell et al. | 248/99 |
| 4,023,842 | 5/1977 | Harvey | 248/99 X |
| 4,052,764 | 10/1977 | Groff | 248/99 X |
| 4,411,300 | 10/1983 | Rico | 248/99 X |
| 4,759,518 | 7/1988 | Yardas | 248/97 |
| 4,768,742 | 9/1988 | Kaaola | 248/99 |
| 4,783,031 | 11/1988 | Ebentheuer | 248/97 |
| 4,805,858 | 2/1989 | Taylor | 248/99 |
| 4,832,292 | 5/1989 | Beckam | 248/99 |
| 4,899,967 | 2/1990 | Johnson | 248/99 X |
| 4,951,903 | 8/1990 | Frey | 248/99 |
| 5,000,406 | 3/1991 | Peterson | 248/99 |
| 5,009,378 | 4/1991 | Linsmayer et al. | 248/99 |
| 5,180,125 | 1/1993 | Caveney | 248/99 |
| 5,183,339 | 2/1993 | Williams | 248/99 X |
| 5,217,271 | 6/1993 | Moe | 248/99 X |
| 5,222,536 | 6/1993 | Hodgdon et al. | 248/99 X |
| 5,271,589 | 12/1993 | Belous | 248/99 X |
| 5,308,027 | 5/1994 | Fullilove | 248/99 X |
| 5,413,394 | 5/1995 | Mitchell | 248/99 X |
| 5,570,862 | 11/1996 | Nugent | 248/99 X |
| 5,588,622 | 12/1996 | Gordon, Sr. | 248/99 X |

*Primary Examiner*—Peter M. Cuomo
*Assistant Examiner*—Rodney B. White
*Attorney, Agent, or Firm*—LaRiviere, Grubman & Payne, LLP

[57] ABSTRACT

A stiffener apparatus, including first and second stiffener body sections, each stiffener section is formed as an open, octagonally shaped structure, and is provided with geometrically shaped channel that facilitate mechanically mating of one section with the other, i.e. a quasi-congruent, multi-planar surface,-snap-ring type construction, that effects a reliable compression of flexible material disposed between the two mating stiffener body sections. The open, octagonally, shaped stiffener sections are especially sized for fitting an opening of a flexible trash bag container. In use, the geometrically shaped mating channels compress the outer edges of the trash bag's opening material between multi-planar surfaces that greatly improves the compression fit in keeping the trash bag opening in an opened state, especially in heavily loaded trash bag conditions. Each one of the stiffener sections, is provided with a scoop-like edge member for channelling material into the trash bag. Additionally, one of the stiffener sections is provided is also provided with a plurality of handles for ease of manipulating, storing and carrying the trash bag with the installed stiffener device.

11 Claims, 4 Drawing Sheets

SNAP-RING STIFFENER APPARATUS HAVING A SCOOP-LIKE EDGE AND METHOD FOR STIFFENING BAG OPENINGS AND OTHER FLEXIBLE FABRICS

FIELD OF THE INVENTION

The present invention relates to stiffeners. More particularly, the present invention relates to stiffeners used for stiffening openings of flexible containers. Even more particularly, the present invention relates to stiffeners for stiffening openings of flexible trash bag containers and for stiffening other flexible sheet material that is functional in a stiffened state.

DESCRIPTION OF THE PRIOR ART

The flexible container, namely the flexible trash bag, has become the norm in management of trash in the residential and commercial environments. While most applications that require the use of a flexible trash bag involve using the product as a trash can liner, there are numerous applications where the flexible trash bag is used by itself without the aid of the trash can to keep the trash bag opened. In the trash can liner application the upper portion of the trash can structure facilitates maintaining the trash bag in an opened state, i.e. creates a stiffened open state of the trash bag opening. The discrete application of the trash bag presents to the user the common problem of keeping the trash bag opened so that trash can be deposited into the trash bag, or whatever item is to be placed inside the trash bag. Typically, the user solves the problem by inserting a curled arm into the trash bag opening to encircle the opening and then uses a free hand for depositing the trash, or other items, into the trash can. The task of trash pick-up in the foregoing manner can become unpleasant when the trash involves picking up pet excrements from the yard. Other tasks where a discrete trash bag is used, and where maintaining the trash bag in an opened state presents a problem, include picking up leaves, grass clippings in a residential environment, and picking up roadside trash by highway department personnel, in a commercial environment.

In spite of the foregoing problems described in using the discrete flexible trash bag, applicant is not aware of any commercially available stiffener devices that are useable to keep the opening of discrete trash bags in an opened state. In particular, applicant is not aware of any stiffener devices that are useable to keep the opening of discrete trash bags in an opened state in applications described above, and which have means for channelling trash items into the trash bag. Thus, a need is seen to exist for a stiffener for openings of flexible trash bag containers.

Other applications besides lawn and garden, that use flexible containers requiring maintaining the opening in an open state include day care centers, sport institutions outdoor activities, kitchens, recycling organizer, shopping bags, and numerous school and club activities. The flexible containers are typically canvas or net bags used to store clothes, toys, sporting equipment, such as balls and other sport gear. The need is seen to exist for a bag opening stiffener apparatus that is rugged and that will withstand robust handling in these other application. Additionally, other applications where flexible sheet material is used in a stiffened state include sifting/sieving and embroidery tasks. The flexible sheet material, such as a mesh material, used in these applications is typically disposed and captured between two snap ring devices to stiffen the mesh material.

The snap ring devices are circular and do not produce a tight and reliable securement of the flexible material. The structure of these snap ring devices is such that a mating compression state comprises an outer, single plane wall of a small ring device expanding against the inner single plane wall of a larger ring device. The plane-plane compression fit is deemed unreliable, especially in sifting heavy material. Thus, a need is seen to exist for a stiffener device that produces a reliable compression fit for retaining and securing flexible sheet material.

It is therefore a primary object of this invention to provide a stiffener device that is useable for keeping the opening of flexible containers in an opened state.

A related primary object of this invention is to provide a stiffener device that is useable for keeping the opening of discrete trash bags in an opened state.

Another object of this invention is to provide a stiffener device that is useable for keeping the opening of discrete trash bags in an opened state, and which has means for channelling trash items into the trash bag.

Yet another object of this invention is to provide a stiffener device that is useable with flexible sheet material to facilitate an intended function of the sheet material.

Yet another object of this invention is to provide a stiffener device adapted for use with flexible sheet material and is provided with structure for ease of handling and designed with means to reliably securing the flexible material to the stiffener device during use.

SUMMARY OF THE INVENTION

Accordingly, the foregoing objects are accomplished by providing a stiffener apparatus formed having a geometrically shaped stiffener body member adapted for stiffening flexible sheet material. The stiffener body member comprises an open structure adapted for compressing outer perimeter portions of the flexible material to effect a stiffened state of the material, and is also provided with clamp structure for clamping and assuring a firmly secure state of the flexible sheet material to the stiffener body member. The stiffener body member is especially designed for maintaining an opening of a flexible container, such as a trash bag, in an opened state. The stiffener body member is further provided with a scooping ramp edge member for channelling material into an opened flexible container. The stiffener body member of the stiffener apparatus is preferably formed comprising first and second stiffener body sections, each stiffener section being formed as an open, octagonally shaped structure, and provided with geometrically shaped channel that facilitate mechanically mating of one section with the other, i.e. a snap-ring type construction, that effects a reliable compression of flexible material disposed between the two mating stiffener body sections. The open, octagonally, shaped stiffener sections are especially sized for fitting an opening of a flexible trash bag container. The geometrically shaped mating channels compress the outer edges of the trash bag's opening material between multiplanar surfaces that greatly improve the compression fit in keeping the trash bag opening in an opened state, especially in heavily loaded conditions. In a stiffened trash bag opening application, the mated stiffener sections maintaining the trash bag opening opened, are provided with mating scooping ramp edge members for channelling material into the trash bag. Additionally, the stiffener section, formed dimensionally as the male component, is provided with a plurality of handles for ease of manipulating, carrying and hanging the trash bag with the installed stiffener device.

Therefore, to the accomplishments of the foregoing object, the invention consists of the foregoing features hereinafter fully described and particularly pointed out in the claims, the accompanying drawings and the following disclosure describing in detail the invention, such drawings and disclosure illustrating but one of the various ways in which the invention may be practiced.

DESCRIPTION OF THE PREFERRED EMBODIMENT OF THE INVENTION

Figure 1:
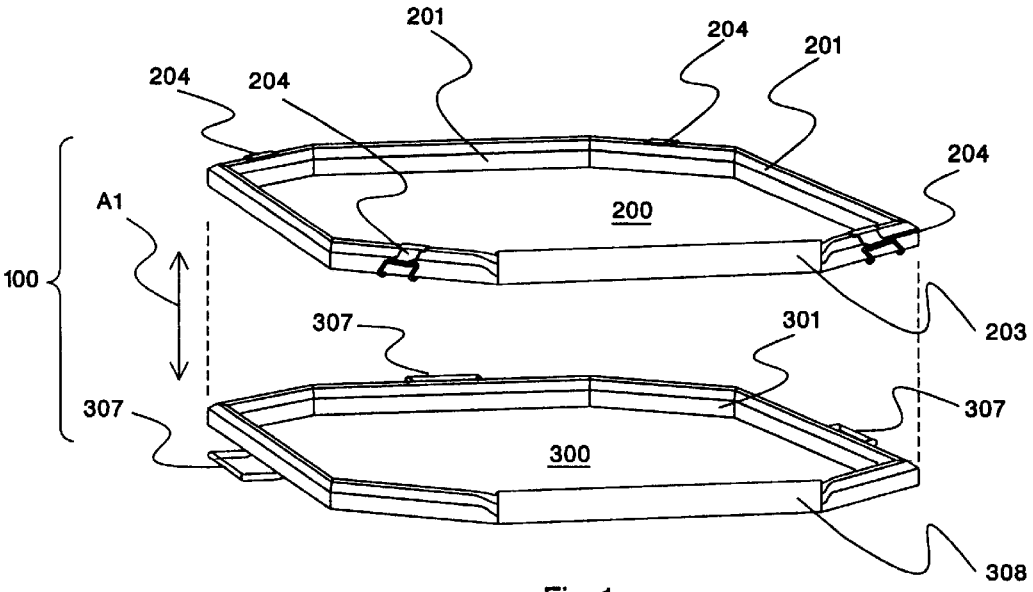
FIG. 1 is a perspective view of a stiffener apparatus in accordance with the present invention showing first and second stiffener sections designed having a octagonal shape.
Figure 2:
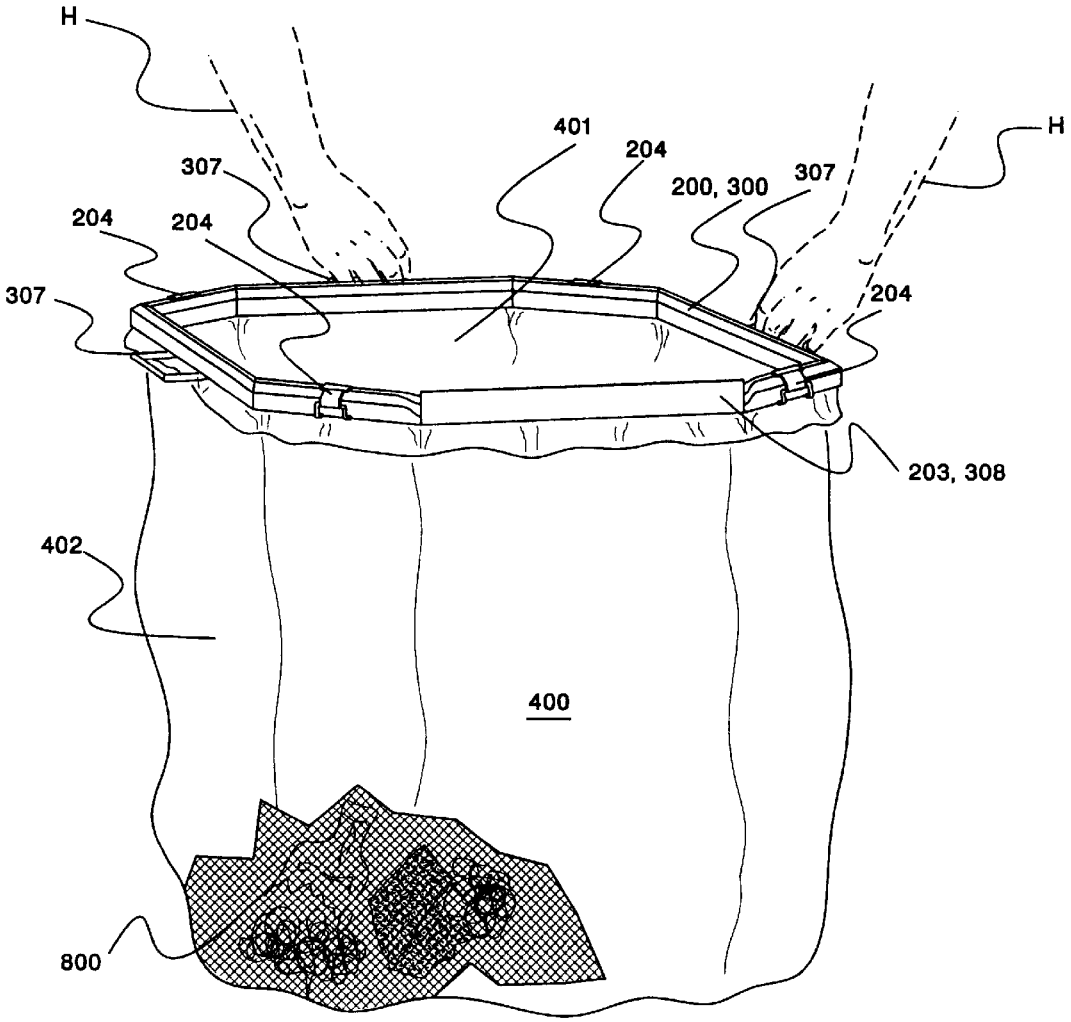
FIG. 2 shows the stiffener apparatus shown in FIG. 1 installed on a flexible trash container being held upright by a person.

FIG. 1 shows a stiffener apparatus 100 in accordance with the present invention showing a first stiffener sections 200 and a second stiffener sections 300, each designed having a octagonal shape. As shown in FIG. 2, stiffener apparatus 100 has particular utility for use in keeping an opening of a flexible trash container 400 in an opened state. As shown in FIG. 1 each stiffener section 200, 300 is an open structure 201, 301 configured in an octagonal shape and designed for mating as indicated by arrow A1. Each section 201, 301 is preferably formed from a rugged, durable, flexible plastic material that is resistant to corrosive chemicals, that can withstand hot (100–130 degrees Fahrenheit) sunny outdoor conditions, and in particular can be used in wet, grimy environments. Stiffener section 200 is provided with a plurality of clamps 204 that are functional for securing stiffener sections 200 and 300 when in a mated state. Both stiffener sections 200 and 300 are provided with mating scooping ramp portions 203 and 308, respectively. As discussed previously, scooping ramp portions 203, 308 have utility for channeling trash items into the opening of a flexible trash container utilizing stiffener apparatus 100. Further, stiffener section 300 is provided with a plurality of handles 307 disposed on structure 301 to facilitate hanging the-in-use stiffener apparatus in a plurality of orientations.

FIG. 2 shows stiffener apparatus 100 installed on a flexible trash container and being held upright by a person's hands H using the provided handles 307 on stiffener section 300. Stiffener section 200 is dimensionally designed as the female component of apparatus 100, while stiffener section 300 is dimensionally designed as the male component of apparatus 100. Although apparatus is shown in FIG. 2 in an application with a flexible trash bag, apparatus 100 has utility with other flexible material and bags, including flexible canvas bags, flexible net bags and flexible sheet mesh material. The illustrated application in FIG. 2 is exemplary and should not be interpreted as a limitation on the invention. As indicated in FIG. 1, each structure 201, 301 is designed for detachably mating as indicated by arrow A1. By design, sections 201, 301 are dimensionally sized for nested engagement as shown in the FIGS. 3, 3*a*, 4, 5, and 6. Thus, the female stiffener structural section 201 engages male stiffener structural section 301 such that the plurality of inner wall surfaces 207, 208, 209, 210 and 211 engage with outer wall surfaces 302, 303, 304, 305 and 306, and such that an inner wall of scoop-like edge member 203 engages with an outer wall of scooping ramp edge member 308. Handles 307 are disposed on stiffener section 300 such that, after engagement, the handles 307 protrude from beneath the structural section 301. Thus, FIG. 2 shows sections 200, 300 in an engaged state where an upper peripheral portion 401 of the opening of trash bag 400 is captured between the structural sections 201, 301, including being captured between scooping ramp edge members 203, 308. Clamp members 204 are distributed about structural section 201 for latching to structural section 301 and assuring a secured engagement of the stiffener sections with the interdisposed portion 401 of trash bag 400. The geometric design of structural sections 201, 301 is preferably a closed-end octagonal loop having a-multi-surfaced, U-shaped channelled body. The octagonal shape provides a plurality of tension points about the circumference of sections 201, 301, and thus create a firm compression state of the captured material 401. Additionally, the multi-surface contact of walls (207, 208, 209, 210, 211), (302, 303, 304, 305, 306) with the interdisposed material 401 also provide tension points that complement the tension points created by the octagonal configuration of sections 201, 301. The firmly held trash bag facilitates carrying heavy trash loads 800 without slipping from the stiffener apparatus. The apparatus 100 is accommodates large sized trash bags 400, typically with a capacity of 33 to 50 gallons, and having elongated sides 402.

Figure 7:
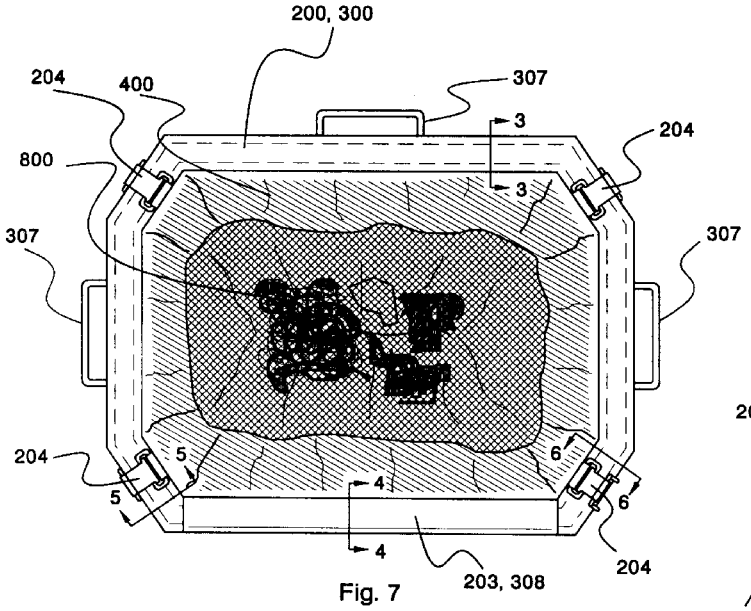
FIG. 7 is a top plan view of the stiffener apparatus with a flexible trash container installed in accordance with the present invention.
Figure 7A:
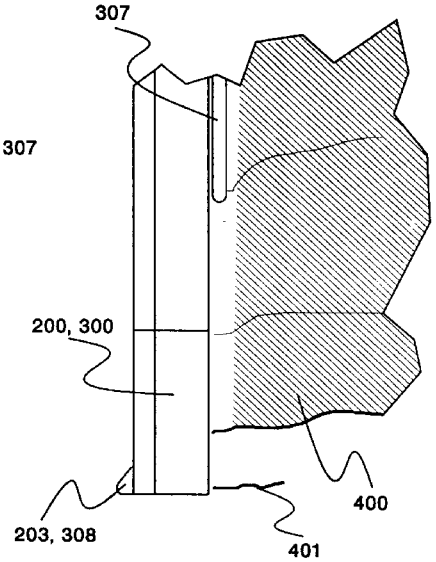
FIG. 7*a* is a side view of the stiffener apparatus with a flexible trash container installed in accordance with the present invention, showing an enlargement of the scooping ramp edge in a position for use in channeling trash into a flexible trash container opening.

FIG. 7 shows a top plan view of the stiffener sections 200, 300 installed on flexible trash container 400 loaded with trash 800. In particular, clamps 204 are shown attached and clamping section 201 to section 301. Handles 307 are provided on three different sides of apparatus 100 to enhance portability, and orientation for hanging from a wall. Also, and as best seen in FIG. 7*a*, apparatus 100 is shown with mated scooping ramp edges 203, 308, which enhance the utility of the stiffener by providing means for channelling trash into a flexible trash container opening.

Figure 3:
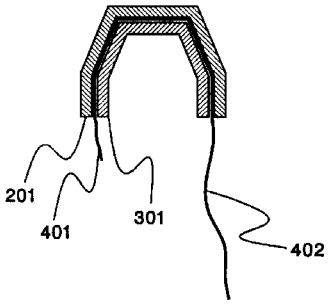
FIG. 3 is a cross section view taken along line 3—3 in FIG. 7 showing the upper edge of the bag opening compressed between the first and second stiffener sections.
Figure 3A:
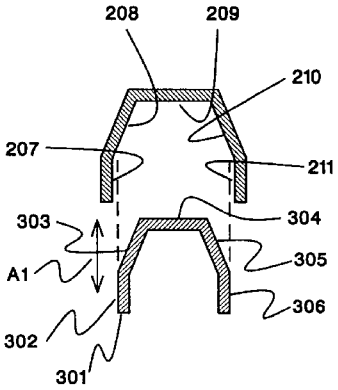
FIG. 3*a* shows a typical mating action of the first and second stiffener sections.
Figure 4:
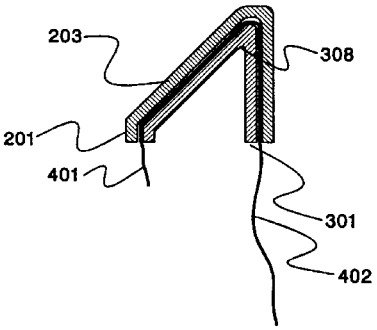
FIG. 4 is a cross sectional view taken along line 4—4 in FIG. 7 showing the scooping ramp edge provided on the stiffener apparatus for channeling trash into a trash container opening.
Figure 5:
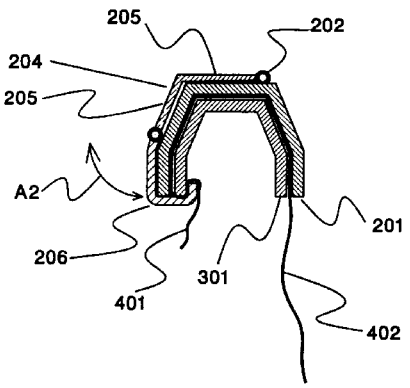
FIG. 5 is a cross sectional view taken along line 5—5 in FIG. 7 showing the clamped state of the first and second stiffener sections.
Figure 6:
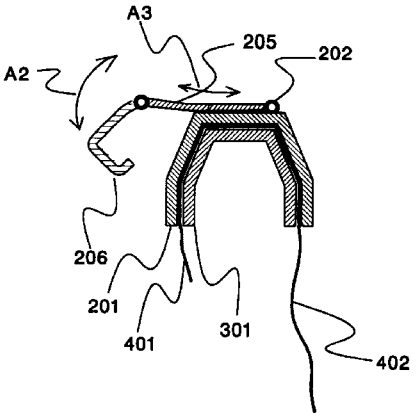
FIG. 6 is a cross sectional view taken along line 6—6 in FIG. 7 showing an unclamped portion of the mated first and second stiffener sections.
Figure 8:
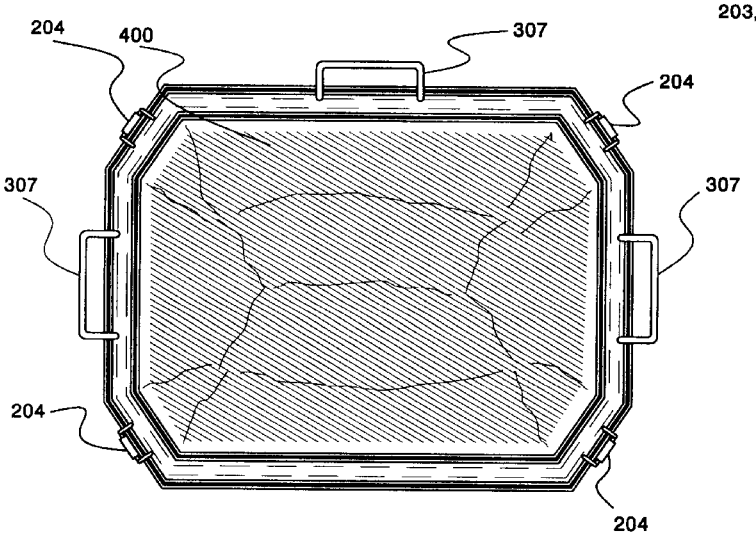
FIG. 8 is a bottom plan view of the stiffener apparatus with a flexible trash container installed in accordance with the present invention.

As discussed previously, the multi-surfaced substantially U-shaped channel construction of sections 201, 301 greatly enhances the gripping capability of the stiffener apparatus. By example, FIG. 3 shows trash bag portion 401 with side 402 in a cross-section view taken along line 3—3 in FIG. 7. Here the upper edge 401 of the bag opening is tightly compressed between the walls of first and second stiffener sections 201, 301. FIG. 3*a* shows a typical mating action, as indicted by arrow A1, for mating section 201 to section 301. The body of sections 201, 301 preferably comprises mating multiple planar surfaces (207, 208, 209, 210, 211), (302, 303, 304, 305, 306) that engage to firmly clamp the sheet material there between. Similarly, corresponding sides of sections 201, 301 comprise scooping ramp edge members 203, 308 that are mechanically mated as indicated in FIG. 4 and comprise a cross-section taken along line 4—4 in FIG. 7. Trash bag portion 401 is also captured between the walls of scooping ramp edges 203, 308. To assure that the stiffener sections 200, 300 remain engaged and firmly securing the opening of the trash bag, stiffener section 201 is provided with a plurality of clamps 204 evenly distributed about stiffener section 201. FIG. 5 shows a cross sectional view taken along line 5—5 in FIG. 7, showing clamp 204 in a clamped state securing stiffener section 201 to stiffener section 301. Arrow A2 shows the pivot action required for hooking hook end 206 to an underside of section 301. Clamp 204 is shown as preferably attached to section 201 by means of a pivot 202 and is formed of an elastic band portion 205, that stretches, as indicated by arrow A3 in FIG. 6, and which facilitates a tensioned securement of section 201 to section 301. FIG. 6 shows a cross sectional view taken along line 6—6 in FIG. 7 showing clamp 204 in an unclamped state. FIG. 8 is a bottom plan view of the stiffener apparatus 100 showing in particular the clamps 204 secured to the underside of stiffener section 301. The elastic characteristic of clamps 204 facilitates securement of different gage thickness of material captured between the two stiffener sections.

Figure 9:
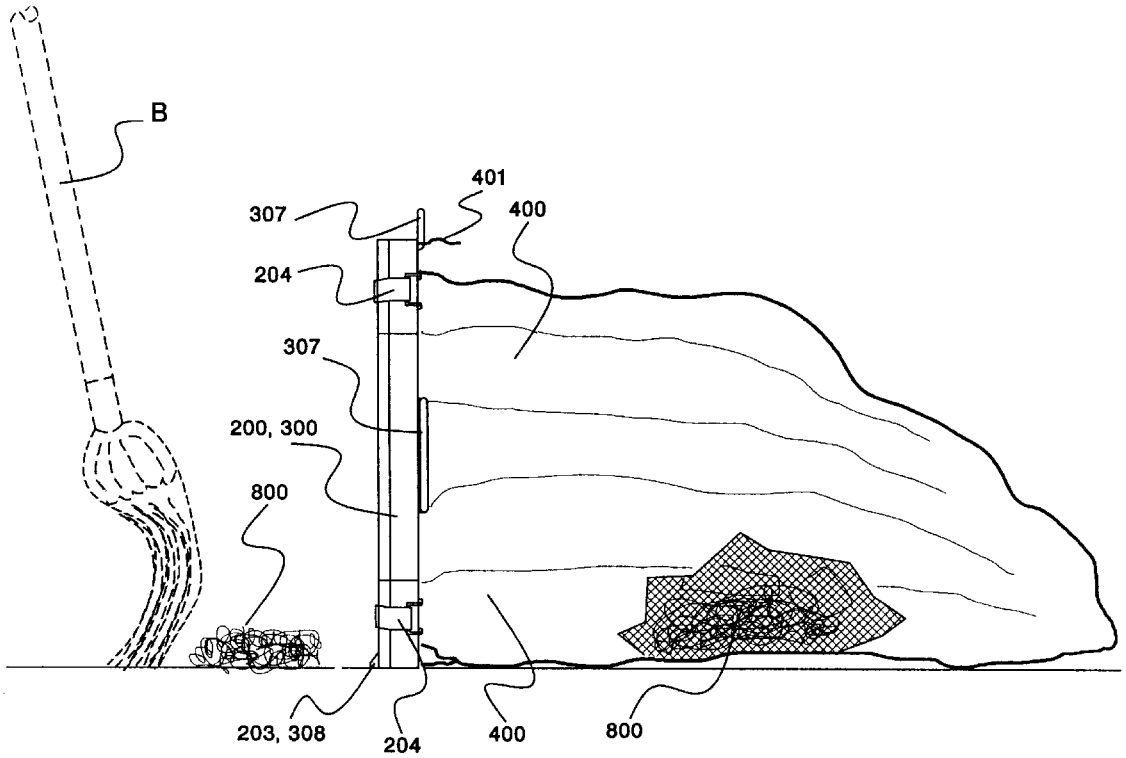
FIG. 9 is a side elevational view showing the stiffener apparatus with a flexible trash container installed in accordance with the present invention, showing the scooping ramp edge being used for channeling trash into a flexible trash container opening.

FIG. 9 shows a preferred application of the present invention. In this application sections 200, 300 are mechanically mated and are used to hold the opening of a trash bag 400 in an opened state. In use, the installed stiffener 100 is positioned in a vertical position, exposing the bag's opening such that the scooping ramp edges 203, 203 are flush with a ground plane to facilitate channeling trash 800, using a broom B, into the flexible trash container 400.

Figure 10:
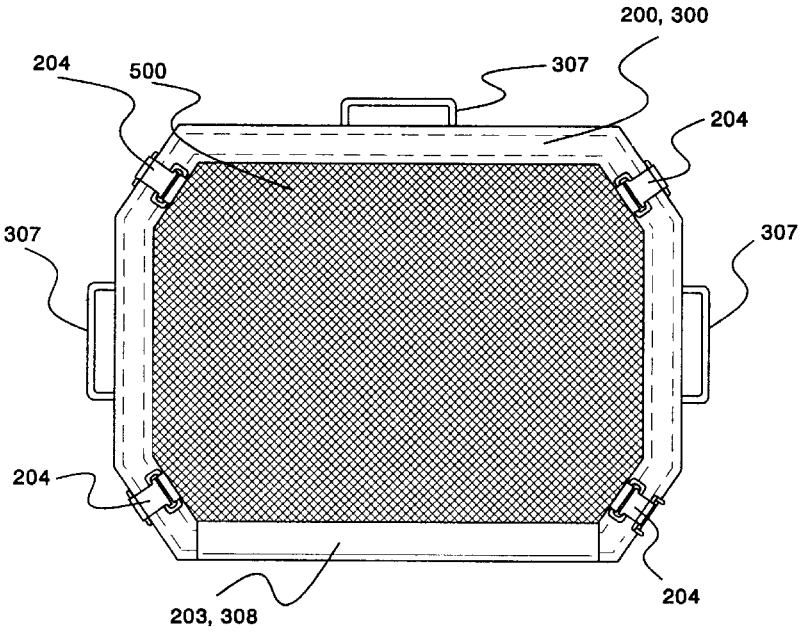
FIG. 10 is a top plan view of the stiffener apparatus with a flexible mesh material installed in accordance with the present invention for use in a sifting/sieving task.

FIG. 10 is a top plan view of the stiffener apparatus 100 with a flexible mesh material 500 installed in accordance with the present invention for use in a sifting/sieving task.

Therefore, while the present invention has been shown and described herein in what is believed to be the most practical and preferred embodiment, it is recognized that departures can be made therefrom within the scope of the invention, which is therefore not to be limited to the details disclosed herein but is to be accorded the full scope of the claims so as to embrace any and all equivalent apparatus.

I claim:

1. A stiffener apparatus for use with flexible sheet material, said apparatus comprising:

a geometrically shaped, open, stiffener body, said stiffener body having a side member provided with an integral scooping ramp edge member;

said stiffener body comprising a first and a second stiffener section;

said first and second stiffener sections being flexible and having a substantially U-shaped cross section;

said first stiffener section dimensionally sized as a female component and said second stiffener section dimensionally sized as a male component, the dimensional sizes of said first and second stiffener section allowing a nested engagement of said second stiffener section within said first stiffener section to facilitate the mechanical mating of said stiffener sections;

said first and second stiffener sections each having a respective side provided with said integral scooping ramp edge member;

said scooping ramp edge members oriented to facilitate the mechanical mating of one scoping ramp edge member within the other;

said first stiffener section provided with a plurality of clamping means pivotally attached and fixed to said first stiffener section, each said clamping means comprises a hinged elastic member having a hook end member that is attachable to said second stiffener section to effect a secured mating engagement of said first and second stiffener sections, and for facilitating a clasped securement of said flexible sheet material when disposed between said first and second stiffener sections; and a plurality of handles provided on said second stiffener section for manipulating said stiffener apparatus.

2. A stiffener apparatus as described in claim 1, wherein: said first and second stiffener sections each having an open octagonal shape.

3. A stiffener apparatus for use with flexible sheet material, comprising:

an octagonally shaped, open, stiffener body, said stiffener body having a side member provided with a scooping ramp edge member;

said stiffener body comprises a first and a second stiffener section, said first and second stiffener sections also forming an open octagonal shape;

said first and second stiffener sections being flexible and having a substantially U-shaped cross section;

said first stiffener section dimensionally sized as a female component and said second stiffener section dimensionally sized as a male component, the dimensional sizes of said first and second stiffener section allowing a nested engagement of said second stiffener section within said first stiffener section to facilitate the mechanical mating of said stiffener sections;

said stiffener body further comprises a plurality of clamping means for securing said sheet material to said stiffener body and a plurality of handles for manipulating said stiffener apparatus; and each of said clamping means comprises being pivotally attached and fixed to said first stiffener section and comprises a hinged elastic member having a hook end member that is attachable to said second stiffener section for effecting a secured mating engagement of said first and second stiffener sections.

4. A stiffener apparatus as described in claim 3, wherein said stiffener apparatus is usable with a plastic bag.

5. A stiffener apparatus as described in claim 3, wherein said stiffener apparatus is usable with a bag constructed of mesh material.

6. A stiffener apparatus for use with flexible sheet material, comprising:

an octagonally shaped, open, stiffener body comprising a first and a second stiffener section;

said first and second stiffener sections being flexible and having a substantially U-shaped cross section;

said first stiffener section dimensionally sized as a female component and said second stiffener section dimensionally sized as a male component, the dimensional sizes of said first and second stiffener section allowing a nested engagement of said second stiffener section within said first stiffener section to facilitate the mechanical mating of said stiffener sections;

each first and second stiffener section having a respective side provided with a scopping ramp edge member designed to facilitate a mechanical mating of one scooping ramp edge member within the other;

said stiffener body further comprises a plurality of clamping means being pivotally attached and fixed to said first stiffener section, each said clamping means comprises a hinged elastic member having a hook end member that is attachable to said second stiffener section to effect a secured mating engagement of said first and second stiffener sections, and for facilitating a clasped securement of said flexible sheet material when disposed between said first and second stiffener sections; and a plurality of handles provided on said second stiffener section for manipulating said stiffener apparatus.

7. A stiffener apparatus as described in claim 6, wherein said stiffener apparatus is usable with a plastic bag.

8. A stiffener apparatus as described in claim 6, wherein said stiffener apparatus is usable with a bag constructed of mesh material.

9. A stiffener apparatus for use with flexible sheet material, said apparatus comprising:

a first and a second stiffener section each being formed having an open octagonal shape;

said first and second stiffener sections being flexible and having a substantially U-shaped cross section;

said first stiffener section dimensionally sized as a female component and said second stiffener section dimensionally sized as a male component, the dimensional sizes of said first and second stiffener section allowing a nested engagement of said second stiffener section within said first stiffener section to facilitate the mechanical mating of said stiffener sections;

each first and second stiffener section having a respective side provided with a scooping ramp edge member designed to facilitate a mechanical mating of one scooping ramp edge member within the other;

said stiffener body further comprises a plurality of clamping means being pivotally attached and fixed to said first stiffener section, each said clamping means comprises a hinged elastic member having a hook end member that is attachable to said second stiffener section to effect a secured mating engagement of said first and second stiffener sections, and for facilitating a clasped securement of said flexible sheet material when disposed between said first and second stiffener sections; and a plurality of handles provided on said second stiffener section for manipulating said stiffener apparatus.

10. A stiffener apparatus as described in claim 9, wherein said stiffener apparatus is usable with a plastic bag.

11. A stiffener apparatus as described in claim 9, wherein said stiffener apparatus is usable with a bag constructed of mesh material.

* * * * *